United States Patent [19]

Stark

[11] Patent Number: 4,695,486

[45] Date of Patent: Sep. 22, 1987

[54] PAINT SHIELDS AND PAINTING METHODS

[76] Inventor: William C. Stark, 306 S. Almansor St., Alhambra, Calif. 91801

[21] Appl. No.: 495,300

[22] Filed: May 16, 1983

Related U.S. Application Data

[63] Continuation-in-part of Ser. No. 176,390, Aug. 8, 1980.

[51] Int. Cl.[4] ..... B05D 1/32

[52] U.S. Cl. ..... 427/282; 118/505; 427/421

[58] Field of Search ..... 427/282, 421; 220/8; 118/505

[56] References Cited

U.S. PATENT DOCUMENTS

| | | | |
|---|---|---|---|
| 21,955 | 11/1858 | Grosholz | 220/8 |
| 61,084 | 1/1867 | Millar | 220/8 |
| 2,880,902 | 4/1959 | Owsen | 220/8 |
| 3,722,470 | 3/1973 | Farrell | 118/505 |

*Primary Examiner*—Norman Morgenstern
*Assistant Examiner*—Janyce A. Bell
*Attorney, Agent, or Firm*—Benoit Law Corporation

[57] ABSTRACT

Self-supporting paint shields are wound into a spiral having an inside diameter different from a diameter of a raised circular object being shielded and having portions overlapping each others sufficiently to remain overlapping when this wound paint shield is adapted in diameter to a raised circular object. The overlapping portions in the wound paint shield are slidable relative to each other and are adapted to remain slidable relative to each other when the wound paint shield is fitted onto the raised object whereby the overlapping portions of the wound paint shield continue sliding relative to each other until the wound paint shield on the raised object is adapted in inside diameter to such raised object and exerts a gripping action supporting the wound paint shield on the raised object, whereby paint may be applied to a surrounding surface exclusive of the shielded object.

47 Claims, 13 Drawing Figures

56
58
23
43
44
46
47
45
57

PAINT SHIELDS AND PAINTING METHODS

CROSS-REFERENCES

This is a continuation-in-part of my copending patent application Ser. No. 06/176,390, filed Aug. 8, 1980 for Paint Shields and Paint Shielding Methods. My prior U.S. Pat. No. 4,331,716, issued May 25, 1982 for Spray Shields and Spraying Methods, and my above mentioned copending patent application Ser. No. 06/176,390 are hereby incorporated by reference herein.

BACKGROUND OF THE INVENTION

1. Field of the Invention

The subject invention relates to painter's equipment and painting methods and, more specifically, to methods of applying paint to a surface exclusive of a shielded further surface or object, to work surface shields, masks and protectors, and to paint shields and shielding assemblies.

2. Disclosure Statement

This disclosure statement is made pursuant to the duty of disclosure imposed by law and formulated in 37 CFR 1.56(a). No representation is hereby made that information thus disclosed in fact constitutes prior art inasmuch as 37 CFR 1.56(a) relies on a materiality concept which depends on uncertain and inevitably subjective elements of substantial likelihood and reasonableness, and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments subsequent in time or priority.

There certainly has been no dearth of proposals in the area of paint shields, painting techniques, wall protectors, surface guards and the like, as may, for instance, be seen from the wall protector disclosed in U.S. Pat. No. 456,775, issued July 28, 1891, the wall protector disclosed in U.S. Pat. No. 624,796, issued May 9, 1899, the wall protecting device disclosed in U.S. Pat. No. 695,965, issued Mar. 25, 1902, the elaborately angled paint guard of U.S. Pat. No. 1,386,706, issued Aug. 9, 1921, the mop board protector of U.S. Pat. No. 1,563,889, issued Dec. 1, 1925, the tool disclosed in U.S. Pat. No. 1,851,497, issued Mar. 29, 1932, the painter's masking shield of U.S. Pat. No. 2,290,472, issued July 21, 1942, the shield for wall moldings of U.S. Pat. No. 2,332,579, issued Oct. 26, 1943, the guard for use in painting and cleaning operations of U.S. Pat. No. 2,517,220, issued Aug. 1, 1950, the wall protector of U.S. Pat. No. 2,538,743, issued Jan. 23, 1951, the surface masking shield of U.S. Pat. No. 2,672,122, issued Mar. 16, 1954, the spray shield of U.S. Pat. No. 2,842,093, issued July 8, 1958, the painting mask of U.S. Pat. No. 2,959,152, issued Nov. 8, 1960, the painters' door shield of U.S. Pat. No. 3,029,782, issued Apr. 17, 1962, the work attached paint shield of U.S. Pat. No. 3,380,435, issued Apr. 30, 1968, the baseboard protecting shield of U.S. Pat. No. 3,422,798, issued Jan. 21, 1969, the interior decorators' aid disclosed in British Patent Specification No. 1 400 406, published July 16, 1975, the paint shielding apparatus of U.S. Pat. No. 4,085,703, issued Apr. 25, 1978, the coating technique and apparatus of U.S. Pat. 3,415,675, issued Dec. 10, 1968, and the door casing hardware paint shield disclosed in U.S. Pat. No. No. 4,195,590, issued Apr. 1, 1980. For completeness' sake, reference may also be had to the picture frames of U.S. Pat. No. 3,237,332, issued Mar. 1, 1966, and U.S. Pat. No. 4,023,293, issued May 17, 1977, which would, however, not be practically usable as paint shields and which are not being proposed for this purpose.

Despite this seeming wealth of proposals, there persisted a heretofore unsatisfied need for practical and highly efficient spray shields of the type disclosed hereinafter, and for practical and highly efficient painting methods employing same.

In this respect, one may, for instance, consider the traditional and persistently followed approach to the painting of doors.

According to one prevailing approach, the installation of door knobs and cover plates is deferred until after the door has been painted. In practice, this introduces time delays and inefficiencies, particularly in large construction projects where the installation of the door and its final outfitting have to be conducted at different intervals.

Another prevailing approach to the painting of doors employs adhesive masking tape, which has to be carefully applied to and around the door knob and cover plate to shield the same when paint is being applied to the surface of the door. A particularly frequent application of this method concerns the repainting of previously painted doors in homes and in various private and public buildings.

In practice, the masking tape method is awkward, time consuming and requires considerable labor. Also, the adhesive of the masking tape tends to leave a residue on the masked surfaces, and the tape cannot always in practice be applied with the precision required for a satisfactory job.

For these and similar reasons, many painters try to do the job without any masking at all, thereby almost invariably leaving unsightly paint dabs on the door knob.

What has so far been said with respect to door knobs and cover plates applies also to painting around other raised objects or closed geometrical shapes or surfaces. Yet, despite their inherent and practical drawbacks, the prior art has not been able to relegate the mentioned approaches to obsolescence and to provide truly efficient and practical and widely acceptable substitutes.

The inherent inefficiencies and other drawbacks of existing shielding technology under consideration stands in sharp contrast to the increasing efficiency of spray and other painting methods. In practice, such improvements are to a considerable extent nullified by inefficient shielding and masking techniques.

With the advent of spray guns, particularly of the airless type, which emit paint at high velocity and narrow angles, the use of hand-held shields has become particularly attractive. However, that approach exposes the painter to real danger when relatively small objects or surfaces are to be shielded, since the impact of high-velocity paint jets on a painter's skin can cause serious injuries including the loss of fingers and entire limbs.

In retrospect, it may appear curious that cups and similar vessels which have been around for a long time apparently have not been creatively applied to the paint shield field, despite the above mentioned pressing needs. However, a review of proposals in that field shows a persistent lack of an acceptable solution.

In this respect, U.S. Pat. No. 2,925,064, issued Feb. 16, 1960, discloses a door knob paint shield composed of two half shells. U.S. Pat. No. 3,722,470, issued Mar. 27, 1973, discloses a paint shield composed of two sheets secured to one another so that they can be bowed outwardly from each other. Swiss Pat. No. 563 251, issued May 15, 1975, discloses a door knob paint shield having a can attached to a handle, and points out that the diameter of door knob escutcheons to be shielded is somewhat smaller than the inside diameter of the can or hollow cylinder.

Accordingly, the paint shield according to that Swiss Pat. No. 563 251 is not self-supporting on the docr knob. Rather, that paint shield can only be used for painting with a brush by hand, since it would have been too dangerous to use that paint shield for a high pressure spray paint operation, given the fact that such paint shield, as disclosed in the cited Swiss patent, has to be held over the door knob with one hand. As has become known in recent years, serious injuries with loss of fingers or limbs can occur if a hand is hit by high-pressure paint.

In particular, the paint shield disclosed in the Swiss Pat. No. 563 251 has to be held at its handle with one hand, while a paint brush is conducted around part of that paint shield with the other hand. During such painting operation, the hands have to be changed, since it is not possible or practical to guide the paint brush with one hand entirely around the hand and arm with which the paint shield has to be held at its handle according to the cited Swiss patent.

In practice, this need to change hands somewhat broadens the unpainted halo inevitably resulting from the use of that paint shield.

The paint shield according to the above mentioned U.S. Pat. No. 3,722,470 similarly leaves unpainted corners at the door knob cover plate, since it is practically impossible to stretch that cornered oval paint shield into a strictly cylindrical configuration. Rather, that paint shield comes open at the seams when such complete stretching against its initial configuration is attempted.

Use of the paint shield according to the above mentioned U.S. Pat. No. 2,925,064 also leaves unpainted portions about the cover plate of the door knob, since spraying paint is able to reach the cover plate through the lateral longitudinal cracks shown in that patent between the half shields.

U.S. Pat. No. 2,358,151, issued Sept. 12, 1944, discloses a mask for shielding a shaft or similar raised object. However, that approach inevitably leaves a wide unpainted circular portion at any otherwise painted surface around the shaft.

Paint shields which work with suction cups, as those disclosed in U.S. Pat. No. 3,335,703, issued Aug. 15, 1967, and British Patent Specification No. 18,938, A.D. 1914, as well as those operating with internal adjustment mechanisms, as disclosed in U.S. Pat. No. 4,196,692, issued Apr. 8, 1980, are similarly impractical for present purposes.

The same may be said of a variety of drinking cups, including the collapsible cups of U.S. Pat. Nos. 21,955, issued Nov. 2, 1858, and 61,084, issued Jan. 8, 1867, and 2,880,902, issued Apr. 7, 1959, the tumbler of U.S. Design Pat. Des. No. 221,135, issued July 13, 1971, the cup of U.S. Design Pat. Des. No. 223,704, issued May 30, 1972 and the cup of U.S. Pat. No. 4,168,676, issued Sept. 25, 1979, all disclosing a frustoconical configuration up to the top opening and a rolled or rounded circular brim about such top opening.

In practice, a frustoconical configuration would work against a retention of such cup on any raised door knob or similar object, and the rolled or rounded circular brim would also promote the occurrence of unpainted rings on the surface adjacent to a shielded door knob or similar raised object. While it cannot be clearly told from U.S. Design Pat. Des. No. 213,546, issued Mar. 18, 1969, what its author had in mind at the opening of its disclosed plastic drinking cup, there is nothing in his disclosure to suggest a deviation from conventional structure.

U.S. Design Pat. Des. No. 193,586, issued Sept. 11, 1962, discloses for its container for dairy products a circumferential rim which juts out radially around the region of the container cup opening. In practice, such a jutting rim portion would be even more detrimental than the rolled or rounded lips of the paint shield of the above mentioned Swiss Pat. No. 563 251 and of the drinking cup references. In particular, such a jutting portion would obstruct the paint brush or spray paint against reaching the entire surface to be painted, such as, the surface of the door immediately adjoining the shielded door knob cover plate or similar raised object.

SUMMARY OF THE INVENTION

It is a general object of this invention to overcome the disadvantages and satisfy the needs expressed or implicit in the above disclosure statement or in other parts hereof.

It is a related object of this invention to provide improved painting systems.

It is a germane object of this invention to provide improved paint shielding systems.

It is also an object of this invention to provide improved methods and means for painting surfaces and structures on a selective basis.

It is a related object of this invention to provide improved methods of applying paint to a first surface surrounding a second surface or an object of specific geometrical shape.

It is also an object of this invention to provide improved devices for shielding a surface or object of specific geometrical shape during painting of a surrounding further surface.

It is a related object of this invention to provide improved apparatus for shielding raised circular objects during painting of surfaces surrounding such objects.

It is also an object of this invention to provide improved assemblies for facilitating painting of surfaces surrounding raised objects.

It is a related object of this invention to provide safer and more efficient methods and means for shielding raised circular objects during painting of surfaces surrounding such objects.

It is a germane object of this invention to safeguard painters against injury from high-pressure spray paint.

Other objects of this invention will become apparent in the further course of this disclosure.

From a first aspect thereof, the subject invention resides in a method of applying paint to a surface surrounding a raised circular object and, more specifically, results in the improvement comprising, in combination, the steps of providing apart from the object a self-supporting paint shield, winding at least part of such self-supporting paint shield apart from the object into a spiral shield having an inside diameter different from a diameter of the circular object and having portions overlapping each other sufficiently to remain overlapping when said spiral shield is adapted in diameter to the circular object. According to one aspect of the invention, the overlapping portions are left or remain slidable relative to each other in said spiral shield. The object is shielded with the paint shield by fitting said spiral shield having the mentioned different inside diameter onto the raised object by changing the spiral shield in inside diameter, with the overlapping portions of said spiral shield sliding relatively to each other until said spiral shield is adapted in inside diameter to the raised object and exerts a gripping action supporting the paint shield on the raised object. Paint may then be applied to the surface surrounding the raised circular object, exclusive of such shielded object.

From a related aspect thereof, the subject invention resides in a device for shielding a raised circular object during an application of paint to a surface surrounding such object, comprising, in combination, a paint shield being self-supporting apart from the object to be shielded, at least part of such self-supporting paint shield being apart from the object wound into a spiral shield having an inside diameter different from a diameter of the circular object and having portions overlapping each other sufficiently to remain overlapping when said spiral shield is adapted in diameter to the circular object. According to an aspect of the invention, the overlapping portions are slidable relative to each other in said spiral shield and are adapted to remain slidable relative to each other when the spiral shield having the different inside diameter is fitted onto the raised object whereby the overlapping portions of the spiral shield continue sliding relatively to each other until the spiral shield is adapted in inside diameter to the raised object and exerts a gripping action supporting the paint shield on the raised object.

Other aspects of the invention will become apparent in the further course of this disclosure, and no limitation to any aspect, object, combination, feature, step or element is intended by this summary of the invention.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
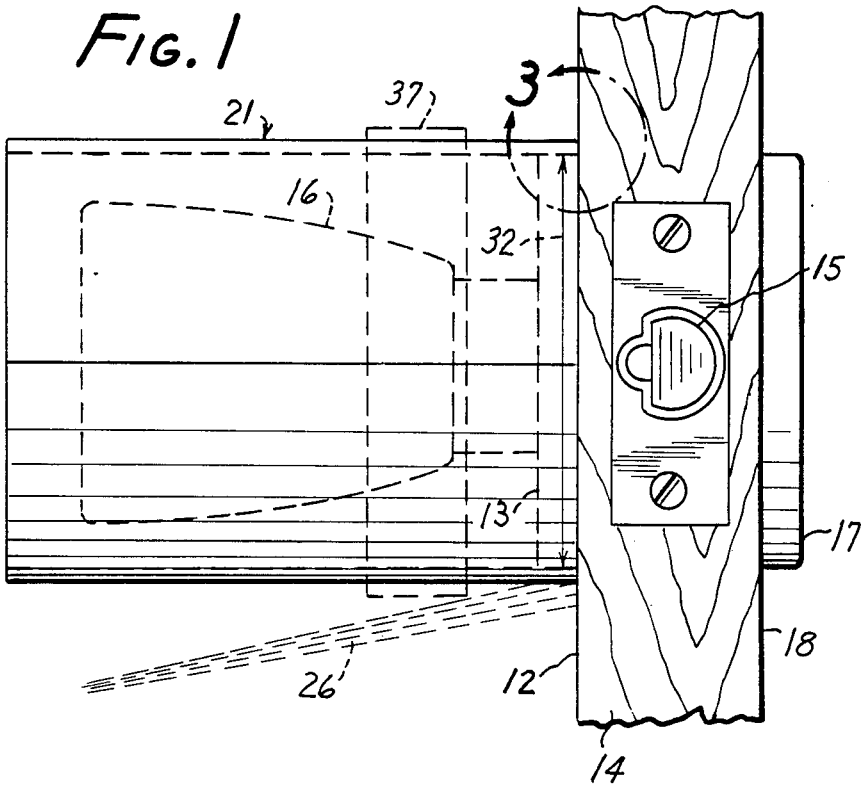
FIG. 1 is a side view of a portion of a door and of a paint shield according to a preferred embodiment of the subject invention.

The accompanying drawings, by way of example, show assemblies for facilitating painting of a surface 12 surrounding a raised object 13. In the drawings, the surface 12 to be painted is a surface of a door 14 having a lock or latch mechanism 15 actuated by a door handle 16 having the raised object 13 as a cover plate or element on the surface 12. In practice, what has been termed herein as "raised object 13" may in fact be just the latter element or the larger door knob structure 16 or a significant part thereof.

Another example of a raised object is shown in FIG. 1 in the form of a cover plate or element 17 of a key-operated door lock. The paint shields of the subject invention may also be employed to shield raised objects of the type of lock portion 17, or may be manufactured for, or adapted to, shielding other kinds of raised objects surrounded by surfaces 18 to be painted.

According to the illustrated preferred embodiments of the subject invention, the assemblies shown therein comprise an inherently self-supporting paint shield 21, 22, 23, 24 or 25 extending or having at least a portion extending about the raised object 13 while paint 26 is being applied to the surface 12 thereabout.

Figure 3:
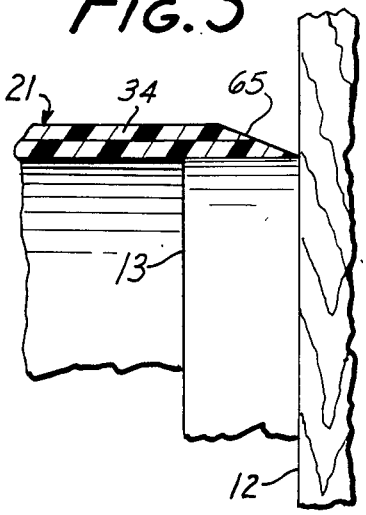
FIG. 3 is a detail view taken approximately within the circular outline 3 in FIG. 1, on an enlarged scale.
Figure 2:
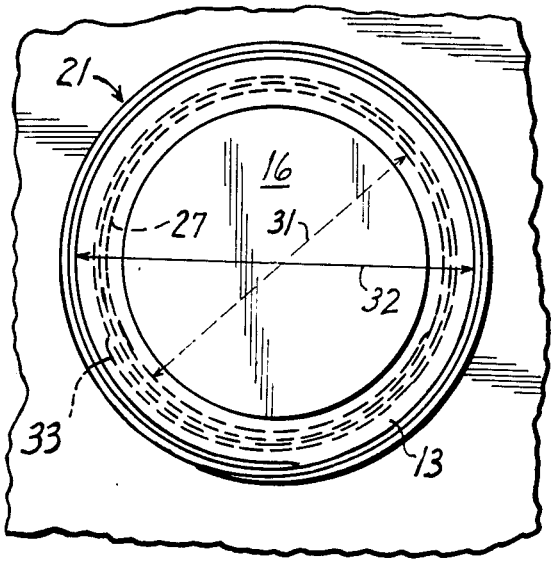
FIG. 2 is a view from the left-hand side of the assembly shown in FIG. 1.
Figure 7:
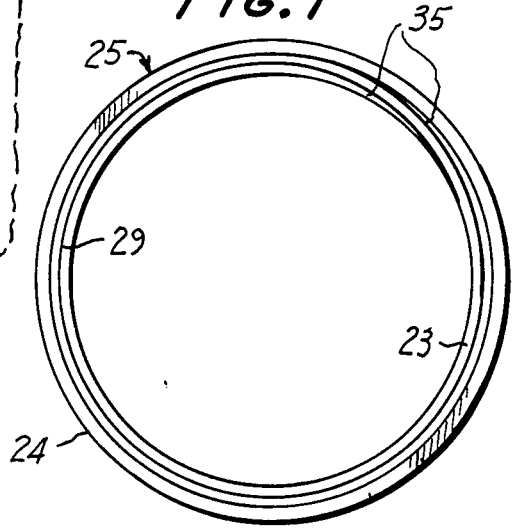
FIG. 7 is a view taken on the line 7—7 in FIG. 6.

At least part of the self-supporting paint shield is wound apart from the raised object 13 into a spiral shield or spiral 27, 28 or 29 having an inside diameter 31 different from a diameter 32 of the circular object and having portions overlapping each other as shown at 33 in FIG. 2, at 34 in FIG. 3, and at 35 in FIG. 7, for instance.

According to the invention, these overlapping portions overlap each other sufficiently to remain overlapping when the spiral paint shield is adapted in diameter to the circular object it is supposed to shield.

As an important point, the overlapping portions at 33, 34, 35 and otherwise are left slidable relative to each other in the spiral paint shield. This is contrary to the prior approach, as apparent from the above mentioned U.S. Pat. No. 3,722,470, which joined a round shield at overlapping edges, so that it could not accommodate itself adequately to a raised circular object, but rather came open at the seams when attempts were made to fit it snugly onto objects which were to be shielded thereby. Accordingly, those prior paint shields either broke during use or had to be manufactured so loosely as to leave unpainted marks on surfaces about the particular objects.

Contrary to such prior approaches, the overlapping portions of the spiral shields according to the subject invention are adapted to remain slidable relative to each other when the spiralpaint shield having the different inside diameter 31 is fitted onto the raised object 13, whereby the overlapping portions at 33 etc. of the paint shield or spiral can continue to slide relative to each other until the wound paint shield or the spiral shield is adapted in inside diameter to the raised object and exerts a gripping action supporting the wound paint shield on such raised object.

In this respect, FIG. 2 shows the spiral 27 of the paint shield 21 in dotted outline at its initially smaller diameter 31. Shields herein disclosed, such as the spiral shields 21 and 22, may be made of a resilient plastic material or of a springy metal, and may be wound or wrapped onto a somewhat smaller diameter 31 than the diameter 32 of the raised object 13 to be gripped by the shield. In this manner, the shield 21 or 22 may be pushed onto the raised object 13, thereby slightly enlarging its diameter and exerting a secure, self-supporting gripping action.

Within the scope of the subject invention, the diameter 31 of the spirally wound paint shield could initially be smaller or larger than the diameter 32 of the raised object to be shielded. In either case, the spiral 27, 28 or 29 is changed in inside diameter, with the overlapping portions at 33, 34, 35, etc. of the spiral paint shield sliding relatively to each other until the wound paint shield or spiral shield is adapted in inside diameter to the raised object and exerts a gripping action supporting the wound or spiral shield on the raised object. In cases such as those of the embodiments shown in FIGS. 1 to 4, the spiral may be manually expanded or contracted to fit onto the raised object, or may be simply pushed thereonto, if necessary with a precessional motion relative to an axis extending perpendicularly through a circular plane of the object 13, or relative to a longitudinal axis through the object 16.

As already indicated above, the paint shield 21 or 22 preferably has or is provided with a resiliency biasing the fitted wound paint shield onto the object 13 when placed thereon, and returning the spiral 27 or 28 to the different inside diameter 31 after a removal from the raised object. Where the inside diameter 31 of the spiral 27 or 28 is smaller than the diameter 32 of the raised circular object 13, the wound paint shield 21 or 22 is fitted onto the raised object 13 by enlarging such spiral in inside diameter.

In the embodiments shown in FIGS. 1 to 8, the wound paint shield 21, 22 or 23 is tensioned into gripping action with the object. As shown at 24 in FIGS. 6 and 7 and in dotted outline at 37 in FIG. 1, a tensioning member encompassing the wound paint shield may be provided for tensioning the wound paint shield into gripping action with the raised object 13. For instance, where the paint shield 21 is not inherently resilient, a rubber band, adjustable clip, Velcro-equipped flexible strip or other means 37 may be employed for tensioning or fastening the wound or spiral shield into gripping action with the rasied object.

Figure 4:
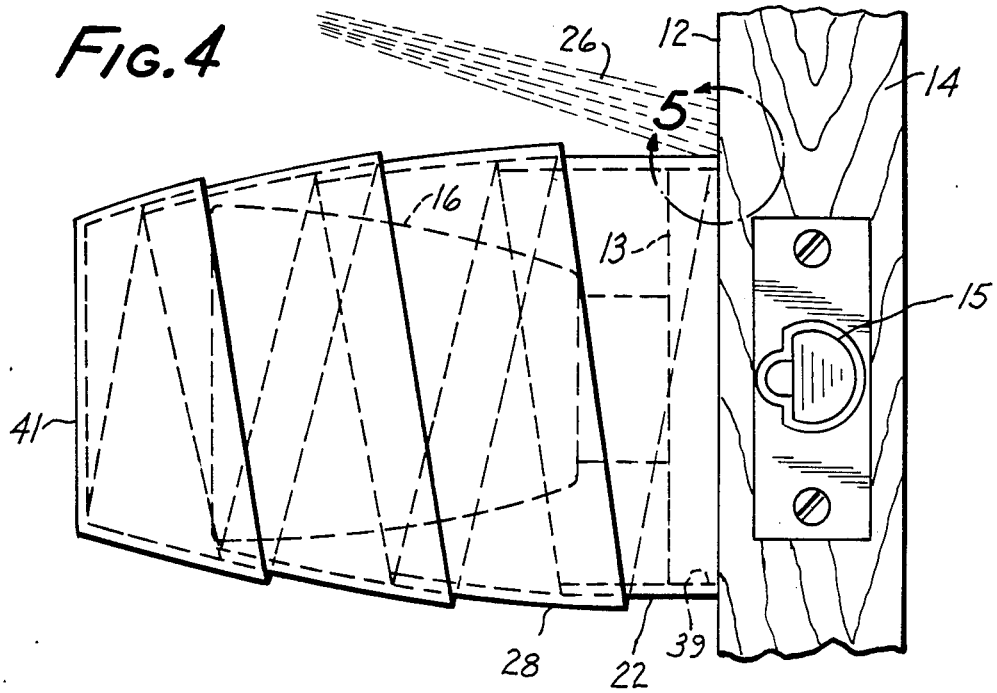
FIG. 4 is a view similar to FIG. 1 showing a voluted paint shield according to a further embodiment of the subject invention.

According to the embodiment shown in FIG. 4, the paint shield spiral 28 is a volute that extends in a helical or scrolled manner from a circular opening 39, the diameter of which is adapted to that of the raised circular object 13 when the shield is set onto the object.

In the voluted paint shield of FIG. 4, the shield portion gripping the raised object at the frontal opening 39 is the innermost turn of the volute, with each succeeding turn overlaying the preceding turn preferably in a tensioning relationship.

The voluted paint shield 22 thus forms its own tensioning member, as is also the case with the cylindrical paint shield of FIGS. 1 to 3, unless provision of a tensioning or fastening member 37 is desired. Like the shield of FIGS. 1 to 3, the voluted paint shield of FIG. 4 may, however, preferably be formed of an inherently resilient material, such as a resilient plastic or a springy metal providing the shield in the form of a wound leaf or volute spring.

Figure 8:
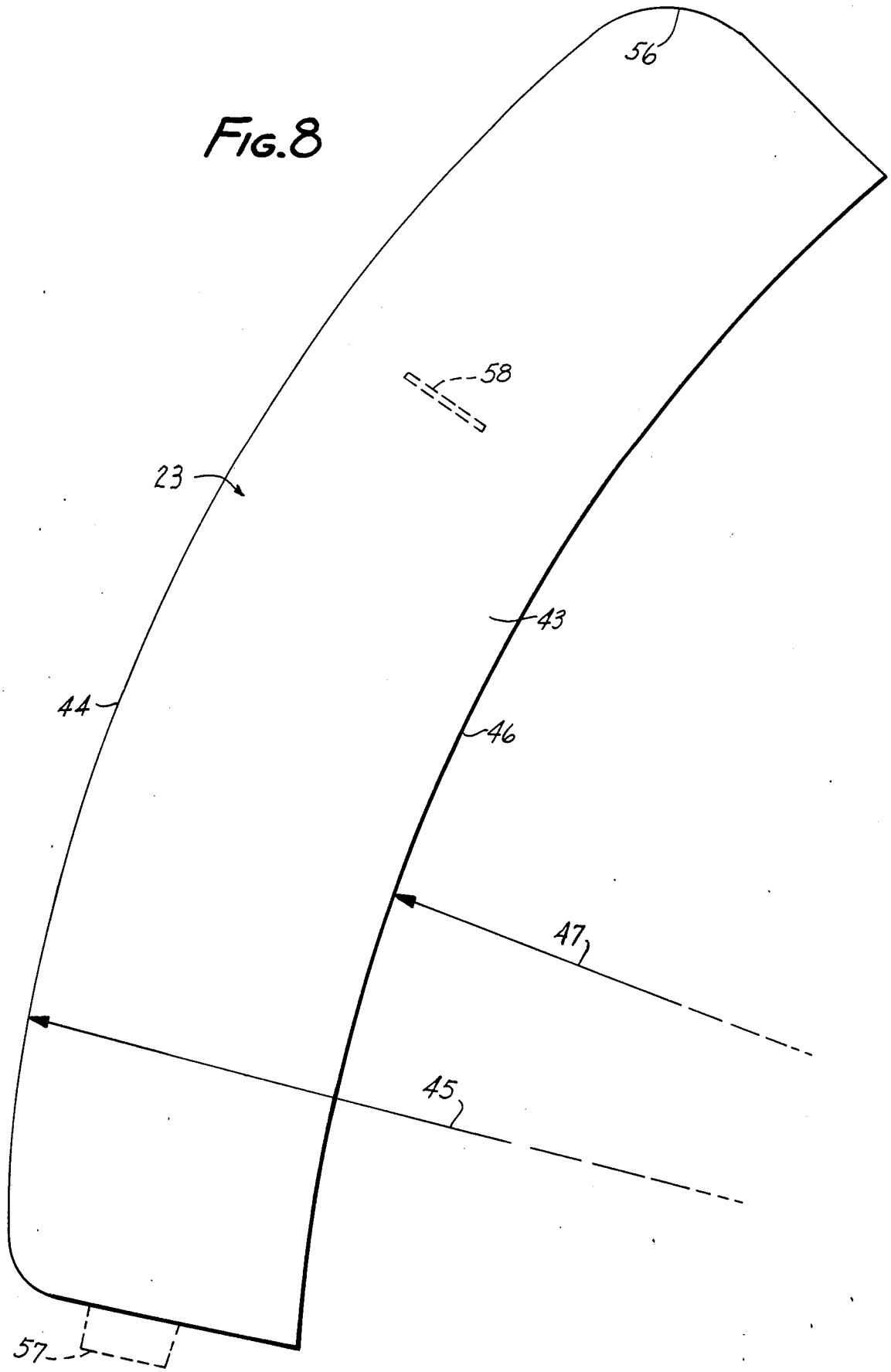
FIG. 8 is a plan view of an insert shield which may be employed in wound form in the assembly of FIGS. 6 and 7.

The spiral paint shield may be covered for a complete enclosure of the shielded object 13, 16 or 17. For instance, each of the paint shields 22 to 25 may be provided with a closed bottom 41. A similar bottom or lid (not shown) may be attached to or otherwise provided at the outer free end of the paint shield shown in FIGS. 1 to 3. As shown in FIG. 8, the wound or spiral shield 23 of the composite paint shield 25 shown in FIGS. 6 and 7 may be wound from a curved or annular segment 43. The periphery 44 of the segment 43 may be curved about a radius 45. The inner curved limit 46 of the segment 43 may be curved about a radius 47. By way of example, with spiral shields being about six centimeters or two and one half inches in diameter, the radii 45 and 47 may be on the order of thirty to thirty-eight centimeters or twelve to fifteen inches. Also by way of example, the segment 43 may be a segmented circumferential outside surface of a cone or frustum. The spiral segment 23 or 43 may be wrapped more than once about a frustum having a base at 48 adaptable to a raised circular object 13 or 63.

The annular segment 43 may, for instance, be made of a strong paper, of a plastic material or of a thin metal sheet. The segment 43 or part or all of a paint shield may be wound apart from the object 13 into a tapered spiral 23 or 29 having at one end 48 thereof an original inside diameter different from a diameter 54 of the circular object and having again portions 35, etc., overlapping each other sufficiently to remain overlapping when the tapered spiral is adapted in diameter to the circular object 13. As before, the overlapping portions at 35, etc., are left slidable relative to each other in the tapered spiral to enable ready adaptation of such tapered spiral to the diameter of the raised circular object.

The raised object 13 is shielded with the composite paint shield 25 or tapered spiral 23 by fitting such tapered spiral, having the mentioned different inside diameter at the one end 48 thereof, onto the raised object by changing the tapered spiral 23 or 29 in inside diameter, with the overlapping portions of the wound paint shield at 35 sliding relatively to each other until the tapered spiral is adapted in inside diameter to that raised object 13, and by applying a force to the tapered spiral for an exertion of a gripping action on the raised object thereby supporting the wound paint shield thereon.

This force preferably is applied circumferentially on the tapered spiral. For instance, the necessary force may be applied to the tapered spiral by arranging such tapered spiral 23 in a circular tension member 24 adapted to tighten the tapered spiral into its gripping action on the raised object 13 by movement of such tensioning member 24 towards the surface 12 surrounding the raised object.

Within the scope of the invention, tensioning means of the type shown in FIG. 1 at 37 and including, for instance, a resilient band, adjustable clip, or Velcro-equipped flexible strip, may instead be used for tensioning the tapered spiral 23 onto the raised object 13.

Within the scope of the invention, the spiral, spiral shield or tapered spiral 26, 22, 23, 27, 28 or 29 could be wound from part of a self-supporting paint shield, and be, for instance, integral with the remainder of such paint shield.

Figure 6:
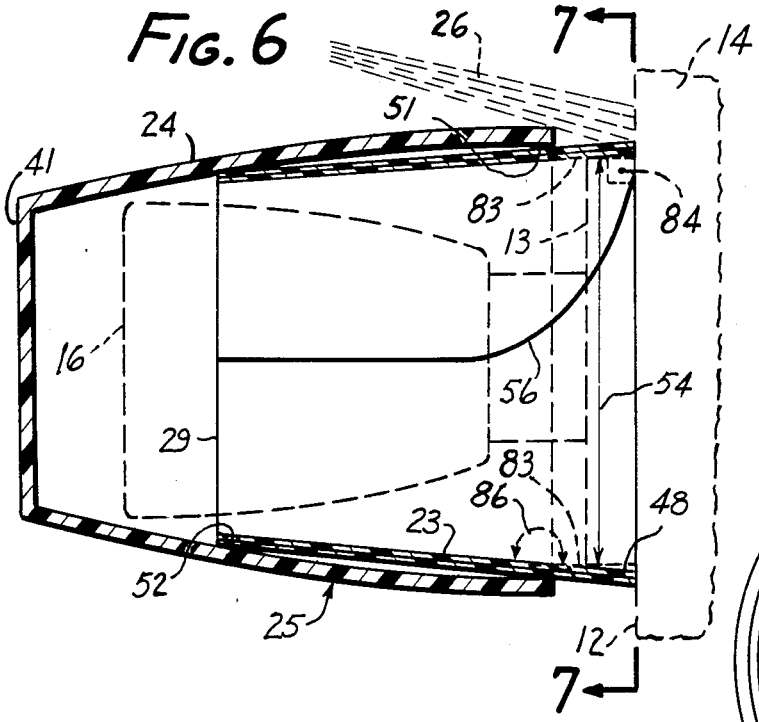
FIG. 6 is a view similar to FIG. 1, partially in section, showing a composite paint shield according to a further preferred embodiment of the subject invention.
Figure 9:
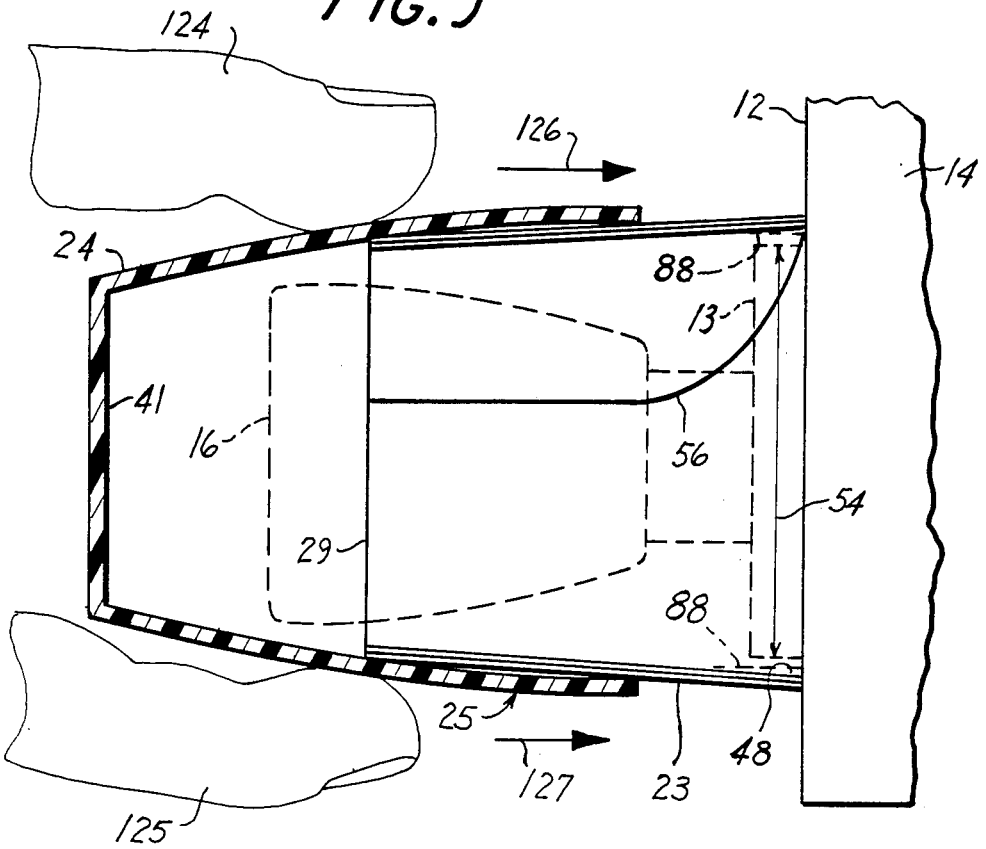
FIG. 9 is a view similar to FIG. 6 showing a setting of a composite shield.

However, according to the preferred embodiment illustrated in FIGS. 6 and 9, the force is applied to the tapered spiral by arranging such tapered spiral 23 in a container 24 adapted to tighten the tapered spiral into the gripping action on the raised object by movement of the container on the tapered spiral towards the surface 12 surrounding the raised circular object 13.

Within the scope of the subject invention, the container 24 may be tapered or have a fustoconical configuration like the tapered spiral 23. In that case, that tensioning member touches the tapered shield 23 over an extended area of contact. On the other hand, according to the preferred embodiment shown in FIG. 6, the tensioning member or container 24 engages the tapered spiral 23 at a first circumferential region 51 corresponding to the front opening of the container 24, and at a second circumferential region 52 corresponding to an annular inside surface of the tensioning member or container 24 recessed or spaced inwardly from the front opening 51.

In the embodiment shown in FIG. 4, the tapered spiral 28 extends helically from its one end at 39 to a bottom 41 of the shield 22, spaced from that one end, with turns of the helically extending tapered spiral 28 being slanted relative to that one end. A similar configuration could be realized with the embodiment or volute 28 shown in FIG. 6, with the tapered spiral 23 then extending helically from one end, such as the end corresponding to the opening 48, to the bottom 41 of the container 24, being slanted relative to the one end.

Where tensioning of the shield is employed, a slight frustoconical configuration of the type shown at 23 serves adjustability. According to the embodiment of the invention illustrated in FIG. 9, the spirally wound segment 43 or tapered spiral shield 23 is inserted into the container 24 so that the inside diameter at opening 48 initially is somewhat larger than the diameter 54 of the raised circular object 13 to be shielded. Holding the composite shield 25 by its container 24, such as with a thumb 124 and one or more fingers 125, the user moves such composite shield over the object 16 until the front portion of the spiral shield 23 contacts the surface 12 around the circular object 13. By further pushing the container 24 in the direction of arrows 126 and 127 toward the surface 12 to be painted or object 13 to be shielded, the user applies via the container 24 at its portions 51 and 52 a circumferential force on the tapered spiral 23, which tightens such spiral since its overlapping portions at 35 according to the subject invention remain slidable relative to each other when the composite paint shield or tapered spiral initially having a different inside diameter at 48 is fitted onto the raised object 13.

The user keeps pushing the container 24 onto the tapered spiral 23, preferably while the insert 23 abuts against the surface 12, whereby the insert 23 is contracted, until that insert or spiral shield 23 is adapted in inside diameter to the raised object and exerts a gripping action supporting the composite paint shield 25 on the raised object 13 against the force of gravity and forces imparted by jets of paint 26 during the painting of the surface 12 surrounding the raised object 13, as seen in FIG. 6.

Figure 10:
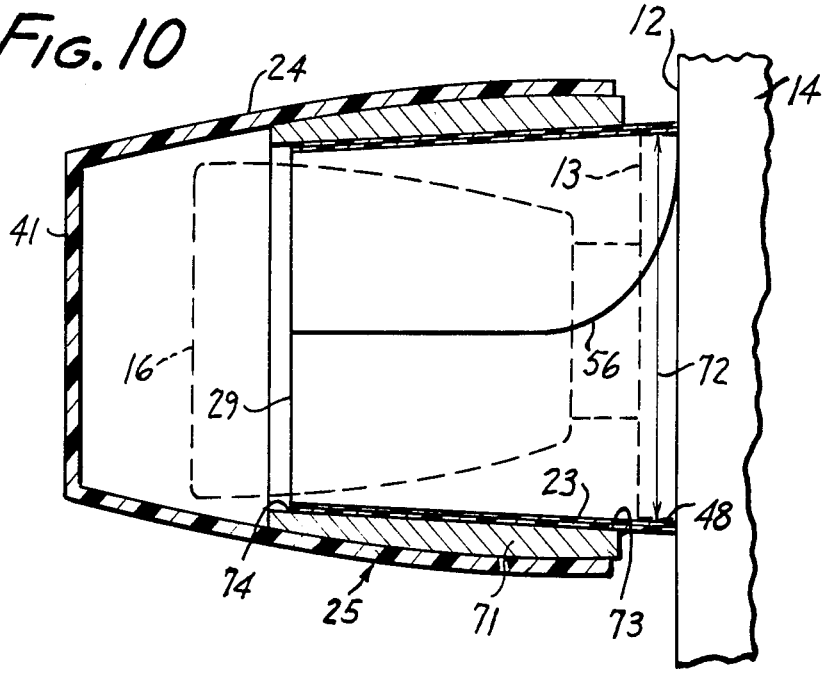
FIG. 10 is a view similar to FIG. 6 showing an adapter and a use thereof according to an embodiment of the invention.

As shown in FIG. 10, the spiral shield 23 may be adapted to a raised circular object 13 with the aid of a circular adapter 71 between the spiral shield 23 and the tensioning member, circular shield or container 24. For instance, the adapter 71 may be employed to adapt the composite paint shield 25 or spiral shield 23 to cover plates or other raised objects having a diameter 72 smaller than the diameter 54 or 61 shown for the raised object 13 in FIGS. 6 and 11.

The adapter 71 may be frustoconical or adapted in outside contour to the adjacent inside contour of the container 24. Alternatively or additionally, the adapter 71 may have an inside contour corresponding to the inside contour of the container 24, whereby the spiral shield 23 may be engaged by the adapter 71 at two spaced regions, such as at a first circumferential region 73 at the front opening of the adapter corresponding to the circumferential region 51 of the container 24, and at a second circumferential region at or about 74 corresponding to the above mentioned circumferential region 52 in the container 24.

With the adapter 71 inserted in the container 24, the composite shield including spiral shield 23 may be set onto the raised circular object in the manner shown in FIG. 9 for the composite shield 25.

It may be noted that the embodiments of FIGS. 6 to 10 present a counterpart to the embodiment of FIGS. 1 to 3, in that the paint shield 21 as shown in FIG. 2, starts with an initially smaller diameter 31 and relies for a shielding action on an expansion of its smaller diameter to that of the raised object, while the embodiments of FIGS. 6 to 10 start out with a larger diameter at the shield opening 48 and diminishes such larger diameter to that of the raised object 13 by action of the tightening member or container 24, thereby also tightening the spiral shield 23 for gripping action onto the raised object 13.

Another difference is that the embodiments of FIGS. 6 to 10 operate with a tightening member or container 24, while an inherently resilient material may be employed in the spiral shields according to the embodiments of FIGS. 1 to 5. Of course, this is not intended to exclude use of an inherently resilient material in a tapered spiral paint shield of the type shown at 23 in FIGS. 6 and 7.

As shown at 56 in FIGS. 6 and 8, at least one of the ends of the spiral shield 23 may be considerably rounded at the shield opening 48, so that it will not interfere with the proper tightening of the spiral shield during placement of the shield on the raised object 13. To practically the same purpose, turns of the tapered spiral 23 may be somewhat constrained against axial movement, such as by means of a tongue 57 projecting from one end of the developed spiral and fitting into a corresponding slot 58 spaced from that one end by a distance corresponding to a circumference of the spirally wound segment 43 or shield 23. Of course, despite use of a tongue and slot 57 and 58 or functionally equivalent means, care is taken that overlapping portions of the spiral remain potentially slidable relative to each other to provide for an adaptation of the shield to the object to be shielded and for a self-supporting tightening thereon.

The spiral shields according to the preferred embodiments shown in FIGS. 1 to 10 are adaptable to circular objects of different diameters. This is a great advantage in practice, where doorknob cover plates and other circular objects have been or are manufactured in a variety of diameters. In this respect, the spiral shield 23 of FIGS. 6 to 10 is the most adaptable, since it can be accommodated in containers 24 etc. of different diameters, and can be equipped with adapters 71 etc. for a gripping and shielding of a large variety of differently sized circular objects. If a tongue 57 is provided as indicated in FIG. 8, corresponding slots 58 may be located at different circumferential distances from the tongue, in order to enable an accommodation of different object diameters.

In recent years, something like a standard doorknob cover plate diameter has emerged among different manufacturers. Provision of a specific paint shield for that standard diameter would, therefore, be a great help to the painter. At the same time, adaptable paint shields of the type shown in FIGS. 1 to 10 are a necessity for consistent overall performance, since not all manufacturers provide a standard cover plate diameter and since even those manufacturers who do frequently provide special series of different diameters.

Figure 11:
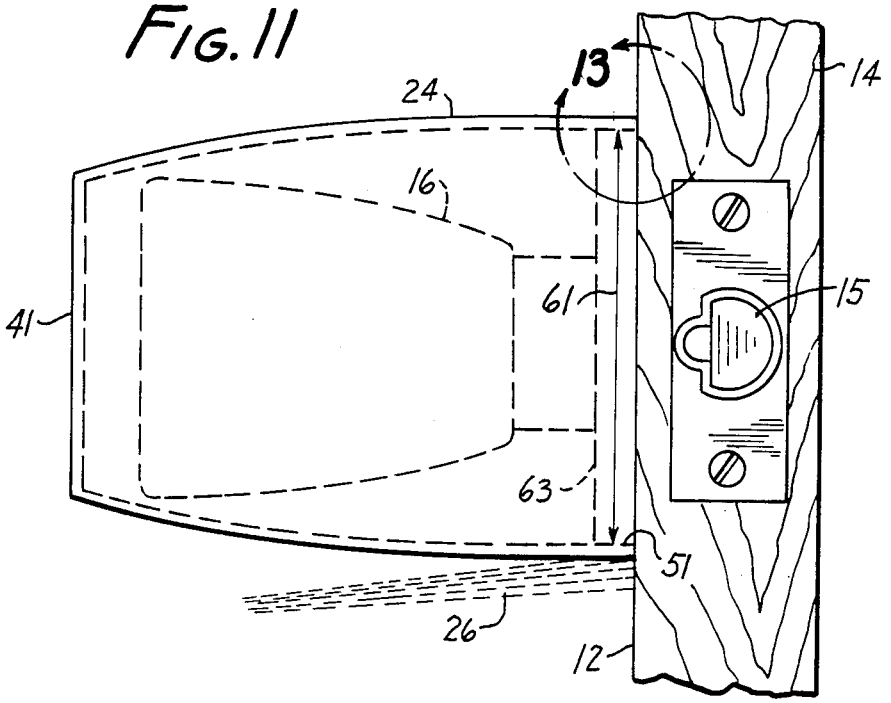
FIG. 11 is a view similar to FIG. 6 showing use of a component of the composite shield of FIG. 6.

In order to accommodate all these needs, a preferred embodiment of the subject invention retains the spiral shield 23 or composite shield 25 adaptable to various diameters, but provides the container 24 with an opening at 51 conforming to the standard cover plate or object diameter 61 shown in FIG. 11.

In general terms, where the spiral shield 23 is adaptable in diameter to one or more certain raised circular objects, the preferred embodiment shown in FIGS. 6 to 11 provides the circular shield or container 24 with a diameter corresponding to a diameter 61 of another raised circular object, which may be somewhat smaller in diameter than the mentioned certain raised circular objects. By way of Preferred example, the frontal diameter of the circular shield or container 24 may be equal to a standard industry diameter for a certain type of door knob plate or cover.

Figure 12:
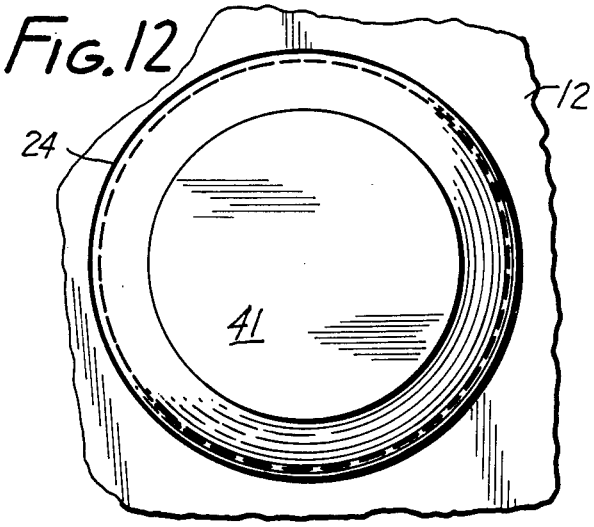
FIG. 12 is a view from the left-hand side of the assembly shown in FIG. 11.
Figure 13:
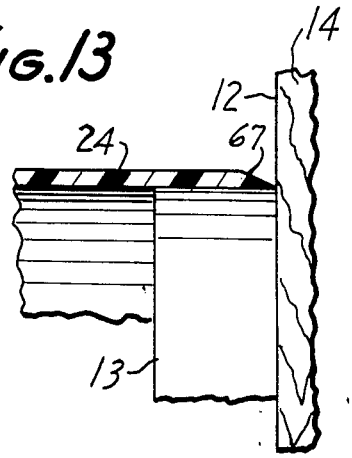
FIG. 13 is a detail view taken approximately within the circular outline 13 of FIG. 11, on an enlarged scale.

As shown in FIGS. 9 to 11, the standard or other object, numbered 63 instead of 13, is shielded by placing the circular shield or container 24 on such standard or other raised circular object 63. The set shield 24 serves functionally as a pressure fitting lid sealing over the raised circular object 63, as shown in FIGS. 11 to 13. Paint 26 is then applied exclusive of the shielded other object 63 to a surface 12 surrounding that other object.

The tensioning member or container 24 has a taper in a direction away from the opening 51 and towards the bottom 41. In practice, this taper enables tightening of the spiral shield 23. The spiral shield 21 of FIGS. 1 to 3, the volute or spiral shield 22 of FIGS. 4 and 5, and the circular shield 24 of FIGS. 6, 7 and 9 to 11, each has a hollow-cylindrical portion at its front opening, extending onto the object 13 or 63 to the surface 12 to be painted at right angles to that surface 12, when the shield is set onto the raised object. This is an important feature which permits the paint shield to grip the raised object most effectively for self-supporting, but manually releasable retention thereon, in proximity to the surface 12 being painted.

The spiral shield 23 may also have or be provided with a hollow-cylindrical wall portion 83 which, as indicated in FIG. 6, preferably extends about the raised circular object 13 at right angles 84 to the surface 12 to be painted. In particular, tapered volute 28 or tapered shield 23 may have or be provided at the raised circular object with a circumferential front portion 83 extending to a remainder of the volute 28 or tapered spiral 23 at an angle 86 of less than 180°. As indicated at 88 in FIG. 9, the hollow cylindrical wall or front portion 83 of the set spiral shield 23 may be realized by providing a circumferential front portion of the shield with a decreased or even reversed taper at the front opening 48. In practice, an outer front portion of the segment 43 may be prestressed or bent for this purpose.

Figure 5:
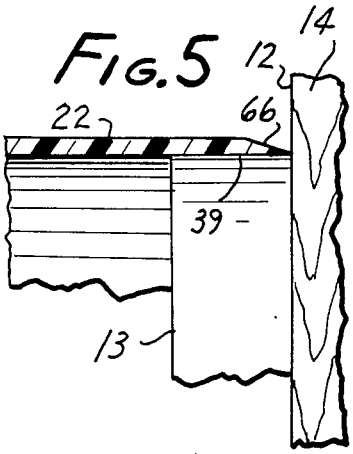
FIG. 5 is a detail view taken approximately within the circular outline 5 in FIG. 4, on an enlarged scale.

As shown in the enlarged section of FIGS. 3, 5 and 13, the paint shields 21, 22 and 24 preferably are provided with a circumferential bevel 65, 66 or 67 defining a sharped-edged brim at the front opening of the shield and thus at the surface surrounding the raised circular object 13 or 63. This in practice permits the paint 26 to extend as closely as possible on the surface 12 to the object 13 or 63, for optimum appearance of the resulting paint job.

A similar circumferential bevel, such as the bevel 65 shown in FIG. 3, may also be provided around the front opening 48 of the spiral shield 23. On the other hand, the combination of that spiral shield 23 with the tensioning member or container 24 in the composite shield 25 enables such shield 23 to be made of very thin material, so that provision of a bevel may not always be necessary.

Unlike a certain bevel shown for the dairy product container of the above mentioned U.S. Design Pat. No. 193,586, the bevels 65 to 67 extend in a continuous or smooth transition from a cylindrical outer surface of the wall portion of the shield to a circular opening of such wall portion or shield adapted to be placed adjacent to the surface 12 surrounding the raised object 13 or 63. Accordingly, there are no laterally projecting or jutting portions at my paint shield bevels 65 to 67 and thus no interference with the application of paint 26 to the surface 12.

In further contrast to the dairy product container of the above mentioned design patent and drinking cups of various other references, the sharp-edged brims according to FIGS. 3, 5 and 13 render my paint shields unsuitable for use as drinking cups or other alimentary vessels.

Where paint 26 is to be applied to the surface 12 up to a predetermined paint thickness, the wall thickness of the paint shield at the surface 12 or at the paint shield opening advantageously may have a thickness corresponding or being equal to the paint thickness to be applied to or built up on the surface 12. In practice, it has been found rather surprisingly that the latter relative dimensioning works satisfactorily in a large number of situations or circumstances, although it ordinarily tends to leave a practically unpainted ring about the raised object, especially when the bevel 65, 66 or 67 is not provided. Interestingly, that ring is, however, tolerable to the eye in many cases, if the disclosed thickness interrelationship is followed.

An even more striking improvement is realized when the setting of the paint shield onto the raised object includes the step of spacing the paint shield on the raised object from the surface 12 by a distance equal to the thickness of the paint being applied to or built up on the surface 12.

In principle, the bottom 41 could be omitted, thereby leaving a rear opening in the paint shield opposite its front opening. This would still laterally shield the raised object 13 or 63, which may be sufficient in case of brush painting or even narrow-angle spray painting. Provision of a closure or bottom 41 in the embodiment of FIGS. 4 to 11, or of an equivalent hood or closure in the embodiment of FIGS. 1 to 3 is, however, preferred where a complete enclosure of the shielded object is desirable or necessary.

According to an aspect thereof, the invention provides apart from the object 13 a self-supporting paint shield 21, 22 or 25, and winds at least part of that self-supporting shield apart from the object 13 onto itself in a circular configuration corresponding to the circular object 13. Such raised circular object is then gripped with that wound shield, whereby such wound shield is set onto the raised object 13 for self-supporting retention thereon. Paint is then applied to the surrounding surface 12 while shielding the object 13 with the set shield 21, 22, 23 or 25.

The paint shield 21, 22, 23 or 24 preferably is provided with a bevel 65, 66 or 67, extending to the surface 12 when said wound shield 21, 22 or 23, or the circular shield 24, is set onto the raised object, or when the object 13 is shielded with the wound paint shield.

According to the embodiment illustrated in FIGS. 1 and 2, the self-supporting shield 21 is wound apart from the object 13 onto itself in a circular hollow-cylindrical configuration about a smaller diameter 31 than a diameter 32 of the circular object and is adapted to extend to the surface 12 at right angles thereto. The object 13 may then be shielded with the wound paint shield by pushing such wound paint shield 21 having the smaller diameter 31 onto the raised object, thereby enlarging the diameter of the wound paint shield and exerting a self-supporting gripping action on the raised object 13, preparatory to an application of paint to the surface 12 exclusive of the shielded object 13.

In structural terms, the paint shield, such as at 21, is self-supporting apart from the object 13 and is wound onto itself apart from such object in a circular configuration about a diameter 31 being smaller than a diameter 32 of the circular object, whereby the shield exerts a self-supporting gripping action when pushed onto the raised object 13.

Again the paint shield preferably has a bevel 65 etc. extending to the surface 12 when the wound shield is set onto a raised object.

The disclosed methods of providing apart from the object 13 or 63 and the surface 12 a self-supporting paint shield, as well as the self-supporting paint shield according to the subject invention, distinguish themselves favorably from the most widely employed prior-art method of providing a masking tape which is typically supported on a roll but is not inherently self-supporting. Rather, the masking tape, when pulled from the roll, is practically limp and has to be skillfully installed by the painter on and around the raised object. Frequently the requisite skill and precision are lacking or cannot be exerted under specific practical circumstances. In consequence, painting jobs of the type herein considered, when executed with masking tape or similar conventional auxiliary means, frequently lack the desired quality and neatness.

This applies also to the use of paint shields which have to be hand-held during paint application. As mentioned above, this raised the additional danger of serious injury to the painter's exposed fingers, hand and arm during high-pressure paint spray application.

The illustrated preferred embodiments of the invention relate to paint shields to be applied over raised circular objects 13, such as circular-rimmed hardware affixed normally to doors, including, for instance, doorknobs, lock plates, cover plates, and other escutcheons which project from doors with a circular surface having radii extending parallel to the door or other surface to be painted and having a central axis extending perpendicularly to that door or other surface.

Each of the illustrated paint shields 21, 22, 23 and 24 has a front opening, such as the opening shown at 39 in FIG. 4 or the equivalent opening in FIG. 1, the opening 48 of the spiral shield shown in FIGS. 6, 9 and 10, and the opening 51 of the solid shield 24 as shown in FIG. 11, for receiving the raised circular object and for gripping that object 13 circumferentially upon the setting of the shield thereon, so that the set shield extends into contact with or close proximity to the door or surface 12 to be painted. The overlapping portions shown at 33 in FIG. 2, at 34 in FIG. 3, and at 35 in FIG. 7, of the illustrated spiral shields 21 and 23, and the overlapping turns of the tapered shield 22 shown in FIG. 4, contact or frictionally engage each other. As these overlapping portions or turns remain overlapping as the spiral shield is set on the raised circular object 13, they also remain in mutual contact or frictional engagement.

This, in turn, assists or preserves the grip of the set shield on the raised circular object 13. For instance, the spiral in the set shield is wrapped tightly around itself in overlapping contact, providing frictional tension originally generated when sliding or setting the spiral taut over the object 13. The slidable contacting surfaces 33, 34, 35, 51 and 52, for instance, of a set spiral shield 21, 22, 23 or 25 are tensioned upon each other. When a spiral shield is tensioned into gripping action upon a raised circular object 13, the tightly contacting tensioned surfaces 33, 34, 35, 51, and 52 of the spiral shield provide the frictional force which enables the front portion of that shield to clamp upon the proximal rim surface of the object 13 to retain the set spiral shield in place against the forces of gravity and impinging paint spray.

The subject invention, which meets all of the above-stated objectives, avoids all of the above mentioned drawbacks and enables neat and efficient paint jobs while eliminating any danger to the painter from the use of high-pressure spray equipment.

The subject extensive disclosure will suggest and render apparent to those skilled in the art various modifications and variations within the spirit and scope of the subject invention and equivalents thereof.

I claim:

1. In a method of applying paint to a surface surrounding a raised circular object, the improvement comprising in combination the steps of:

providing apart from said object a self-supporting paint shield;

winding at least part of said self-supporting paint shield apart from said object into a spiral shield having an inside diameter different from a diameter of said circular object and having portions overlapping each other sufficiently to remain overlapping when said spiral shield is adapted in diameter to said circular object;

leaving said overlapping portions slidable relative to each other in said spiral shield;

shielding said object with the paint shield by fitting said spiral shield having said different inside diameter onto said raised object by changing said spiral shield in inside diameter, with said overlapping portions of said spiral shield sliding relatively to each other until said spiral shield on said raised object is adapted in inside diameter to said raised object and exerts a gripping action supporting the paint shield on said raised object; and applying paint to said surface exclusive of said shielded object.

2. A method as claimed in claim 1, including the step of:

providing said spiral shield with a hollow-cylindrical wall portion extending about said raised circular object at right angles to said surface.

3. A method as claimed in claim 1, wherein:

said paint shield is provided with a resiliency biasing said fitted spiral shield onto said object when placed thereon, and returning said spiral shield to said different inside diameter after a removal from said raised object.

4. A method as claimed in claim 1, wherein:

said inside diameter of said spiral shield is made smaller than said diameter of the raised circular object; and said spiral shield is fitted onto said raised object by enlarging said spiral shield in inside diameter.

5. A method as claimed in claim 1, including the step of:

tensioning said spiral shield into gripping action with said object.

6. A method as claimed in claim 1, including the steps of:

providing a tensioning member encompassing said spiral shield; and tensioning said spiral shield with said tensioning member into gripping action with said object.

7. A method as claimed in claim 1, including the step of:

providing said spiral shield with a sharpedged brim at said surface surrounding the raised circular object.

8. A method as claimed in claim 1, including the step of:

covering said spiral shield for a complete enclosure of said shielded object.

9. A method as claimed in claim 1, including the step of:

disposing said spiral shield in a circular shield for tensioning said spiral shield into said gripping action on said raised object.

10. A method as claimed in claim 9, including the step of:

adapting said spiral shield to said raised circular object with the aid of a circular adapter between said spiral shield and said circular shield.

11. A method as claimed in claim 9, including the steps of:

providing said circular shield with a diameter corresponding to a diameter of another raised circular object for exertion of a gripping action by said circular shield on said other object;

shielding said other object by placing said circular shield on said other raised circular object; and applying paint exclusive of said shielded other object to a surface surrounding said other object.

12. A method as claimed in claim 11, including the step of:

providing said circular shield with a circumferential bevel defining a sharp-edged brim at said surface surrounding the raised circular object.

13. In a method of applying paint to a surface surrounding a raised circular object, the improvement comprising in combination the steps of:

providing apart from said object a self-supporting paint shield;

winding at least part of said self-supporting paint shield apart from said object into a tapered spiral having at one end thereof an inside diameter different from a diameter of said circular object and having portions overlapping each other sufficiently to remain overlapping when said tapered spiral is adapted in diameter to said circular object;

leaving said overlapping portions slidable relative to each other in said tapered spiral;

shielding said object with said tapered spiral by fitting said tapered spiral having said different inside diameter at said one end thereof onto said raised object by changing said tapered spiral in inside diameter with said overlapping portions of said tapered spiral sliding relatively to each other until said tapered spiral on said raised object is adapted in inside diameter to said raised object and by applying a force to said tapered spiral for an exertion of a gripping action on said raised object supporting the paint shield thereon; and applying paint to said surface exclusive of said shielded object.

14. A method as claimed in claim 13, including the step of:

providing said tapered spiral at said raised circular object with a circumferential front portion extending to a remainder of said tapered spiral at an angle of less than 180°.

15. A method as claimed in claim 13, wherein:

said force is applied circumferentially on said tapered spiral.

16. A method as claimed in claim 13, wherein:

said force is applied to said tapered spiral by arranging said tapered spiral in a circular tensioning member adapted to tighten said tapered spiral into said gripping action on said raised object by movement of said tensioning member toward said surface surrounding the raised circular object.

17. A method as claimed in claim 16, including the step of:

providing said tapered spiral with a sharpedged brim at said surface surrounding the raised circular object.

18. A method as claimed in claim 13, wherein:

said force is applied to said tapered spiral by arranging said tapered spiral in a container adapted to tighten said tapered spiral into said gripping action on said raised object by movement of said container on said tapered spiral toward said surface surrounding the raised circular object.

19. A method as claimed in claim 18, including the step of:

adapting said tapered spiral to said raised circular object with the aid of a circular adapter between said tapered spiral and said container.

20. A method as claimed in claim 18, including the steps of:

providing said container with a diameter corresponding to a diameter of another raised circular object for exertion of a gripping action by said container on said other object;

shielding said other object by placing said container on said other raised circular object; and applying paint exclusive of said shielded other object to a surface surrounding said other object.

21. A method as claimed in claim 20, including the step of:

providing said container with a circumferential bevel defining a sharp-edged brim at said surface surrounding the raised circular object.

22. A device for shielding a raised circular object during an application of paint to a surface surrounding said object, comprising in combination:

a paint shield being self-supporting apart from said object;

at least part of said self-supporting paint shield being apart from said object wound into a spiral shield having an inside diameter different from a diameter of said circular object and having portions overlapping each other sufficiently to remain overlapping when said spiral shield is adapted in diameter to said circular object;

said overlapping portions being slidable relative to each other in said spiral shield and being adapted to remain slidable relative to each other when said spiral shield having said different inside diameter is fitted onto said raised object whereby said overlapping portions of said spiral shield continue sliding relatively to each other until said spiral shield on said raised object is adapted in inside diameter to said raised object and exerts a gripping action supporting the paint shield on said object.

23. A device as claimed in claim 22, wherein:

said spiral shield has a hollow-cylindrical wall portion adapted to extend about said raised circular object at right angles to said surface.

24. A device as claimed in claim 22, wherein:

said paint shield has a resiliency biasing said fitted spiral shield onto said object when placed thereon, and returning said spiral shield to said different inside diameter after a removal from said raised object.

25. A device as claimed in claim 22, wherein:

said inside diameter of said spiral shield is smaller than said diameter of the raised circular object whereby said spiral shield is fitted onto said raised object by enlarging said spiral shield in inside diameter.

26. A device as claimed in claim 22, including:

means on said spiral shield for tensioning said spiral shield into gripping action with said object.

27. A device as claimed in claim 22, including:

a tensioning member encompassing said spiral shield for tensioning said spiral shield into gripping action with said object.

28. A device as claimed in claim 22, wherein:

said spiral shield has a sharp-edged brim at said surface surrounding the raised circular object.

29. A device as claimed in claim 22, including:

means for covering said spiral shield for a complete enclosure of said shielded object.

30. A device as claimed in claim 22, including:

a circular shield encompassing said spiral shield for tensioning said spiral shield into said gripping action on said raised object.

31. A device as claimed in claim 30, including:

means for adapting said spiral shield to said raised circular object, including a circular adapter between said spiral shield and said circular shield.

32. A device as claimed in claim 30, wherein:

said circular shield has a diameter corresponding to a diameter of another raised circular object for exertion of a gripping action by said circular shield on said other object whereby said other object is shieldable with said circular shield.

33. A device as claimed in claim 30, wherein:

said circular shield has a sharp-edged brim at said surface surrounding the raised circular object.

34. A device for shielding a raised circular object during an application of paint to a surface surrounding said object, comprising in combination:

a self-supporting paint shield wound into a tapered spiral having at one end thereof an inside diameter different from a diameter of said circular object and having portions overlapping each other and being slidable relative to each other in said tapered spiral for adaptation of said tapered spiral in diameter to said circular object; and means on said tapered spiral for applying a force to said tapered spiral for an exertion of a gripping action on said raised object when said tapered spiral is placed thereon.

35. A device as claimed in claim 34, wherein:

said tapered spiral has a circumferential front portion adapted to extend at said raised circular object to a remainder of said tapered spiral at an angle of at less than 180°.

36. A device as claimed in claim 34, wherein:

said force-applying means include means for applying said force circumferentially on said tapered spiral.

37. A device as claimed in claim 34, wherein:

said force-applying means include a circular tensioning member on said tapered spiral for tightening said tapered spiral into said gripping action on said raised object upon movement of said tensioning member toward said surface surrounding the raised circular object.

38. A device as claimed in claim 34, wherein:

said tapered spiral has a sharp-edged brim at said surface surrounding the raised circular object.

39. A device as claimed in claim 34, wherein:

said force-applying means include a container adapted to tighten said tapered spiral into said gripping action on said raised object upon movement of said container on said tapered spiral toward said surface surrounding the raised circular object.

40. A device as claimed in claim 39, including:

means for adapting said spiral shield to said raised circular object, including a circular adapter between said tapered spiral and said container.

41. A device as claimed in claim 39, wherein:

said container has a diameter corresponding to a diameter of another raised circular object for exertion of a gripping action by said container on said other object for a shielding of said other object by said container.

42. A device as claimed in claim 40, wherein:

said container has a sharp-edged brim at said surface surrounding the raised circular object.

43. A device as claimed in claim 34, wherein:

said tapered spiral extends helically from said one end, with turns of said helically extending tapered spiral being slanted relative to said one end.

44. A device as claimed in claim 34, wherein:

said tapered spiral extends helically from said one end to a bottom of the shield spaced from said one end.

45. In a method of applying paint to a surface surrounding a raised circular object, the improvement comprising in combination the steps of;

providing apart from said object a self-supporting paint shield;

winding said self-supporting shield apart from said object onto itself in a circular hollow-cylindrical configuration about a smaller diameter than a diameter of said circular object and being adapted to extend to said surface at right angles thereto;

providing said paint shield with a circumferential bevel extending to said surface when said object is shielded with said wound paint shield;

shielding said object with said wound paint shield by pushing said wound pain shield having said smaller diameter onto said raised object thereby enlarging the diameter of said wound paint shield and exerting a self-supporting gripping action on said raised object; and applying paint to said surface exclusive of said shielded object.

46. In a method of applying paint to a surface surrounding a raised circular object, the improvement comprising in combination the steps of:

providing apart from said object a self-supporting paint shield;

winding said self-supporting shield apart from said object onto itself in a circular configuration corresponding to said circular object;

providing said paint shield with a bevel extending to said surface when said wound shield is set onto said raised object;

gripping said raised circular object with said wound shield whereby said wound shield is set onto said raised object for self-supporting retention thereon; and applying paint to said surface while shielding said object with said set shield.

47. A device for shielding a raised circular object during painting of a surface surrounding said raised object, comprising:

a paint shield being self-supporting apart from said object and being wound onto itself apart from said object in a circular configuration about a diameter being smaller than a diameter of said circular object whereby said shield exerts a self-supporting gripping action when pushed onto said raised object; and said paint shield has a bevel extending to said surface when said wound shield is set onto a said raised object.

* * * * *